US008356719B2

(12) United States Patent
Haltmayer et al.

(10) Patent No.: US 8,356,719 B2
(45) Date of Patent: Jan. 22, 2013

(54) CROCKERY BASKET AND DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen, DE (US); Jens Schlichtmeier, Günzburg (DE); Martin Weissenburger, Bissingen (DE); Mark Woldenberg, Bachhagel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/934,072

(22) PCT Filed: Mar. 23, 2009

(86) PCT No.: PCT/EP2009/053397

§ 371 (c)(1),
(2), (4) Date: Sep. 23, 2010

(87) PCT Pub. No.: WO2009/118295

PCT Pub. Date: Oct. 1, 2009

(65) Prior Publication Data

US 2011/0025179 A1 Feb. 3, 2011

(30) Foreign Application Priority Data

Mar. 26, 2008 (DE) ..... 10 2008 015 713

(51) Int. Cl.
*A47G 19/08* (2006.01)

(52) U.S. Cl. ..... 211/41.8

(58) Field of Classification Search ..... 211/41.1–41.9, 211/50, 85.25, 85.31, 133.5, 126.9, 132.1, 211/169, 181.1; 312/228.1; 134/135, 56 D, 134/137, 134

See application file for complete search history.

(56) References Cited

U.S. PATENT DOCUMENTS

| | | | | |
|---|---|---|---|---|
| 1,822,087 | A * | 9/1931 | Feingold | 211/198 |
| 3,124,251 | A * | 3/1964 | Guth | 211/41.8 |
| 3,752,322 | A * | 8/1973 | Fiocca et al. | 211/41.8 |
| 4,046,261 | A * | 9/1977 | Yake | 211/41.8 |
| 4,606,464 | A * | 8/1986 | Jordan et al. | 211/41.8 |
| 4,917,248 | A * | 4/1990 | Friskney | 211/41.8 |
| 4,927,033 | A * | 5/1990 | Patera et al. | 211/41.9 |
| 5,351,837 | A * | 10/1994 | Smith | 211/41.8 |
| 5,480,035 | A * | 1/1996 | Smith | 211/41.8 |
| 5,601,195 | A * | 2/1997 | Finola et al. | 211/41.8 |
| 6,546,942 | B2 * | 4/2003 | Smith et al. | 134/201 |
| 6,571,965 | B1 * | 6/2003 | Beck et al. | 211/41.8 |
| 6,827,225 | B2 * | 12/2004 | Miilu et al. | 211/41.9 |

(Continued)

FOREIGN PATENT DOCUMENTS

DE 7235591D U 6/1973

(Continued)

*Primary Examiner* — Teri P. Luu
*Assistant Examiner* — Hiwot Tefera
(74) *Attorney, Agent, or Firm* — James E. Howard; Andre Pallapies

(57) ABSTRACT

A crockery basket of a dishwasher for receiving pieces of crockery. The crockery basket includes a bottom; lateral parts that frame the bottom; and at least one row of rods that are arranged on the bottom to hold the pieces of crockery. The at least one row of rods has a base wire and individual rod wires that are attached to the base wire. Each end of the base wire is bent and pivotally mounted on the bottom. When the at least one row of rods is pivoted upright, the base wire is arranged at a distance from the bottom.

14 Claims, 2 Drawing Sheets

U.S. PATENT DOCUMENTS

| | | | | |
|---|---|---|---|---|
| 6,848,585 | B2 * | 2/2005 | VanLandingham | 211/41.9 |
| 7,231,929 | B2 * | 6/2007 | Landsiedel et al. | 134/135 |
| 7,682,465 | B2 * | 3/2010 | Anderson et al. | 134/56 D |
| 7,766,175 | B2 * | 8/2010 | Jadhav et al. | 211/41.9 |
| 7,931,155 | B2 * | 4/2011 | Bastuji | 211/41.9 |
| 2003/0089672 | A1 * | 5/2003 | VanLandingham | 211/41.8 |
| 2005/0109378 | A1 * | 5/2005 | Landsiedel et al. | 134/135 |
| 2005/0236344 | A1 * | 10/2005 | Yang et al. | 211/41.4 |
| 2006/0108298 | A1 * | 5/2006 | Kim | 211/41.8 |
| 2006/0237379 | A1 * | 10/2006 | Yang et al. | 211/41.4 |
| 2007/0226928 | A1 * | 10/2007 | Bastuji | 15/104.8 |
| 2008/0029465 | A1 * | 2/2008 | Yang et al. | 211/41.5 |
| 2008/0083678 | A1 * | 4/2008 | Graute | 211/41.8 |
| 2008/0302740 | A1 * | 12/2008 | Moser et al. | 211/41.8 |
| 2009/0120883 | A1 * | 5/2009 | Jadhav et al. | 211/41.9 |

FOREIGN PATENT DOCUMENTS

| | | | |
|---|---|---|---|
| DE | 29921601 | U1 | 3/2000 |
| DE | 10204692 | A1 | 8/2003 |
| EP | 1106134 | A1 * | 6/2001 |
| EP | 1665975 | A1 | 12/2004 |
| FR | 2915364 | A1 | 10/2008 |
| JP | 11206691 | A | 8/1999 |
| JP | 2006239140 | A | 9/2006 |

* cited by examiner

CROCKERY BASKET AND DISHWASHER

BACKGROUND OF THE INVENTION

The present invention relates to a crockery basket of a dishwasher for receiving pieces of crockery, comprising a bottom and lateral parts framing the bottom, at least one row of rods for holding the pieces of crockery being arranged on the bottom of the basket, said row consisting of at least one base wire for the rods and at least one row of rods which is fixed to the base wire and consists of individual rod wires, as well as a dishwasher comprising a corresponding crockery basket.

A crockery basket is disclosed in DE 72 35 591 U which comprises a bottom which is framed by lateral parts. The bottom and lateral parts consist of individual wires which are connected together. For receiving pieces of crockery, wave-shaped wires extending parallel are provided on the bottom of the crockery basket, on which rod wires are fixedly arranged by one respective end. The other end of the respective rod wire freely projects into the inside of the basket. The wave-shaped wires serve together with the rod wires for receiving pieces of crockery. A drawback with this embodiment of a crockery basket is the costly production of the crockery basket due to the wave-shaped wires. The wave-shaped wires which are located in the bottom region have the further drawback that pieces of crockery, in particular small plates, received between the wave-shaped wires and the rod wires project into a region below the crockery basket. As a result, damage to the pieces of crockery by a spray arm frequently arranged below the crockery basket may not be excluded. Moreover, by the fixed arrangement of the rod wires it is difficult to fill the crockery basket with large pieces of crockery.

A crockery basket for dishwashers is disclosed in DE 299 21 601 U1, in which a row of rods is arranged on the bottom of the basket for holding the pieces of crockery. The row of rods consists of a base wire for the rods and a row of rods fixed thereto consisting of individual rod wires. The base wire for the rods is located on the bottom of the crockery basket which is a wire mesh. The pieces of crockery are held by two rows of rods between two respective rod wires. The rows of rods may, if required, be folded up and placed against the bottom. The bearing arrangement is implemented by additional, bent wires in the base mat of the crockery basket, which engage around the base wire for the rods. A drawback in this case is that the bearing point is also at the same time the point at which the piece of crockery has to be held. It is thus not guaranteed that the pieces of crockery are held in a stable and protective manner. If the pieces of crockery are, for example, small plates, they project through the base mat of the crockery basket and may be damaged by a movement of a spray arm, which is arranged below the wire basket in the dishwasher. Moreover, the piece of crockery may come into contact with the wires of the base mat of the bottom of the crockery basket, as a result of which the piece of crockery is only held in an unstable manner and may also be damaged.

BRIEF SUMMARY OF THE INVENTION

It is the object of the present invention to avoid the above-disclosed drawbacks and to ensure a stable position of a piece of crockery in the crockery basket, thus avoiding damage to the piece of crockery and improving the rinsing performance and drying. The loading options of the crockery basket, moreover, are intended to be flexible.

The object is achieved by a crockery basket and a dishwasher having the features of the independent claims.

According to the invention, a crockery basket of a dishwasher for receiving pieces of crockery comprises a bottom and lateral parts which frame the bottom. At least one row of rods for holding the pieces of crockery is arranged on the bottom of the basket. The row of rods consists of at least one base wire for the rods and at least one row of rods consisting of individual wires which is fixed to the base wire for the rods. The ends of the base wire for the rods are angled, i.e. bent, and pivotally mounted on the bottom of the basket. The fastening of the base wire for the rods to the bottom produces a row of rods in the crockery basket which may be folded relative to the bottom. As a result, the crockery basket itself is able to be used in a variety of ways. When the row of rods is upright, for example, plates or small bowls may be arranged in order and received spaced apart between the rod wires for improved cleaning and avoiding damage. For cleaning larger pieces of crockery, the row of rods may be folded away and thus create space for receiving pans, for example. By means of the bearing arrangement of the base wire on the end thereof, the retention of the pieces of crockery is not negatively affected as the base wire is mounted at a point which is not used at the same time for supporting the pieces of crockery. Damage to the pieces of crockery by the bearing components is thus avoided.

According to the invention, the base wire is, moreover, at a distance from the bottom of the basket in the region of the row of rods when the row of rods is pivoted upright. By means of the present invention, for retaining the piece of crockery between the rod wires without additional wires or additional parts and in a simple and cost-effective manner, a spacing is created for a piece of crockery from the bottom of a crockery basket. The pieces of crockery are not held in the plane of the bottom but in a plane located thereabove, whereby downwardly projecting parts of the pieces of crockery remain inside the crockery basket. As a result, the pieces of crockery are both mounted in a stable manner and thus also protected from damage, and the pieces of crockery outside the crockery basket are prevented from being damaged by moving parts inside the dishwasher. Moreover, when pulling out and pushing in the crockery basket in and/or out of the dishwasher the pieces of crockery are prevented from striking housing parts of the dishwasher and being able to be damaged as a result.

The retention of the pieces of crockery in the rows of rods according to the invention is achieved without substantial additional cost when manufacturing the crockery basket. By angling and/or bending the ends of the base wire for the rods, and by fastening these angled ends of the base wire for the rods to the bottom, the central region of the base wire for the rods to which the individual rod wires are fastened, in particular, is raised relative to the bottom and at the same time a bearing point is produced for folding over the row of rods. In particular, a spacing of the base wire for the rods from the bottom is produced between the central region of the base wire for the rods and the bottom. If the pieces of crockery are positioned and held at least partially on the base wire for the rods, these pieces of crockery, in particular small plates, project in the region between the base wire for the rods and the bottom, but not as far as underneath the bottom. They are thus protected against damage from below. Generally, the pieces of crockery are held by two rows of rods configured in the same manner, each individual piece of crockery being arranged on two parallel extending base wires for the rods and between a total of four rod wires. The piece of crockery is thus held above the bottom. By the rotatable mounting of the row of rods, the crockery basket is divided up in a flexible manner.

Advantageously, the bottom consists of a base mat made of wire. This base mat, which substantially corresponds to a wire mesh, is able to be produced cost-effectively and ensures easy accessibility to the piece of crockery for the cleaning liquid and effective drying of the piece of crockery. The base mat made of wire permits good stability of the crockery basket with the least possible covering of the piece of crockery in terms of access by the cleaning liquid as well as the best possible draining of the piece of crockery to be dried.

If the base wire is arranged with its ends on the bottom and/or on the base mat, preferably by means of one respective rotary bearing element a particularly simple connection between the base mat of the bottom and the base wire for the rods of the row of rods is thus achieved. The rotary bearing element may either be implemented by the shaping of the wires relative to one another or a separate rotary bearing element is used which is connected to the bottom and/or the base mat, and rotatably guides the base wire for the rods. The row of rods is thus flexibly arranged in the crockery basket and thus permits, on the one hand, a stable retention of the pieces of crockery and, on the other hand, the creation of a large volume of space without sub-divisions, in which large pieces of crockery may also be mounted and cleaned.

If one of the bearing elements is a loose bearing for rotatably mounting the row of rods and the other bearing element is a fixed bearing for the base wire, resulting production tolerances of the bearing elements, the fastening points of the bearing elements at the bottom and/or the base mat and the row of rods with the base wire for the rods may be easily compensated.

A particularly simple and thus preferred fastening of the bearing element on the bottom, in particular on the wires of the base mat is thus achieved by the bearing element being clipped onto components of the bottom and/or onto the wires of the base mat. The mounting is particularly simplified as a result.

If the bearing element advantageously has a catch for the end of the base wire for the rods, the row of rods is held in the corresponding position, in particular in the upright position. The pieces of crockery may, as a result, be easily introduced into the rows of rods without said rows of rods tending to fold away. Only by intentionally rotating the row of rods, is it possible to move said row of rods from the latched position into the other position by a slightly greater application of force.

It is advantageous if at least one end of the base wire has a double bend in which preferably both bends follow one another substantially at right angles and the piece of wire after the second bend runs substantially parallel again to the piece of wire in front of the first bend. The bending is preferably carried out substantially in the plane of the row of rods. As a result, the piece of wire of the base wire for the rods extending between the first and second bend substantially determines the extent of the spacing of the row of rods and/or the base wire for the rods from the bottom. The end of the wire after the second bend permits a very simple connection with the rotary bearing on the bottom, in particular on the base mat of the bottom, by said end of the wire being inserted into the bearing arrangement and, as a result, being rotatably connected to the bottom.

If, according to a further expedient development, at least one end of the base wire advantageously has a triple bend, on the one hand, by means of the corresponding bearing arrangement a rotatable connection to the bottom, in particular a base mat made of wire, is possible in a very simple manner. On the other hand, the end piece of the base wire for the rods may be used as a stop for the row of rods. This is possible, in particular, when, proceeding from the rod wires, the first two bends of the base wire for the rods are substantially in the plane of the row of rods and the third bend at the end of the base wire for the rods is in a plane which is arranged substantially at right angles to the first plane. If the bend is additionally in a direction, in particular, which faces away from the folding direction of the rod wire, the end of the wire forms a stop at the end after the third bend, via which the upright row of rods may be supported, for example, on a supporting surface provided in the bearing element. At least one of the ends of the base wire for the rods is expediently angled adjacent to the rotational axis and forms thereby the stop for limiting a tilting motion of the row of rods about the rotational axis. It is, however, naturally also possible for both ends to be correspondingly angled. The row of rods is spaced from the bottom by the piece of wire between the first and the second bend.

It is particularly advantageous if the end of the base wire with the triple bend forms the stop. Only small production costs are necessary in order to maintain this additional advantage of a tilting stop for the row of rods. The stop may namely also be produced at the end with the double bend, but is only able to be produced there with additional cost for the bearing elements.

It is particularly advantageous if one end of the base wire has a triple bend and the other end has a double bend. Whilst the end with the triple bend adjacent to the rotational axis with a fixed bearing also produces a stop preventing the rod wire from tilting too far upwards, the end of the base wire with the double bend forms a loose bearing, in which the end of the base wire remains freely movable in the longitudinal direction, in order to be able to compensate for tolerances. As a result, compensation is possible of the production tolerances of the base mat of the crockery basket and the row of rods with the base wire for the rods. By increasing the permissible production tolerances, a measure is again implemented in order to permit cost-effective production of the crockery basket according to the invention.

Advantageously, the two ends of the base wire for the rods have regions extending aligned with one another, which form the rotational axis of the row of rods. Specific components or measures are thus no longer necessary. The rotation of the row of rods is already made possible by the shape of the base wire.

The spacing of the base wire from the bottom of the crockery basket is, in particular, determined by the length of the angled ends of the base wire. By being fastened to the bottom of the crockery basket said angled ends produce a spacing for the retaining points for the piece of crockery. The piece of crockery is thus received between two rows of rods and is located between a total of four rod wires, and bears against the two base wires of the row of rods. Advantageously, the spacing of the base wire for the rods from the bottom of the crockery basket means that a piece of crockery received therein, in particular a plate, does not come into contact with the bottom of the crockery basket and/or the base mat or does not even protrude therethrough. The piece of crockery is, as a result, received in a stable manner and additionally protected from damage.

Preferably, the rod wires are aligned obliquely relative to the base wire. As a result, the reception of bulky pieces of crockery is simplified and by an oblique position of the pieces of crockery both the cleaning and the drying of the pieces of crockery improved. By the oblique position of the pieces of crockery, horizontally extending points are not produced on the piece of crockery, or only a few horizontally extending points, so that the water may run off rapidly and without leaving drying marks behind.

A dishwasher with a crockery basket disclosed above is able to be produced in a cost-effective manner and provides a very effective cleaning and drying performance of the pieces of crockery located therein.

By means of the crockery basket constructed according to the invention, by creating a spacing for a piece of crockery from the base mat of a crockery basket it is prevented that undefined bearing points are produced on the piece of crockery, whereby the rinsing performance and drying is improved. Whilst in comparable dishwashers a spacing is created by means of additional wires and/or additional parts, which by their incorporation into the cutlery basket increase the costs, a cost-effective and reliable crockery basket is provided by the present invention. The invention discloses a flexible row of rods of a crockery basket by which it is possible, without the use of additional wires, to lift pieces of crockery away from a base mat and to prevent bearing points. The spacing is preferably produced by specifically bending the base wire for the rods at the start and end. In a preferred embodiment, the row of rods has two different bends at the ends. An advantage in the construction of the crockery basket according to the invention, in particular, is the simplified production which is incorporated into the rod production and only requires a small additional cost for angling and/or bending the ends of the wires. No additional bent and/or angled wire is necessary, whereby a saving is achieved in time and cost in comparison with known solutions. In order to hold the flexible rod in position, preferably two elements are provided at the start and at the end of the row of rods which, in particular, ensure a latching in the upright and/or folded position. Optionally, therefore, one latching element may advantageously serve as a fixed bearing and one element may serve as a loose bearing in order to compensate for the resulting production tolerances. According to an expedient development, a bend in the base wire on the loose bearing side advantageously also produces a reduction in the torsion of the row of rods, as the wire is supported on the bearing. When inserting pieces of crockery, which are actually too large, into the row of rods, impermissible folding out of the row of rods outwardly is thus avoided.

Further developments of the invention are provided in the sub-claims.

BRIEF DESCRIPTION OF THE DRAWINGS

The invention and the developments thereof as well as the further advantages thereof are disclosed in the following exemplary embodiments, in which schematically.

DETAILED DESCRIPTION OF EXEMPLARY EMBODIMENTS OF THE PRESENT INVENTION

Figure 1:
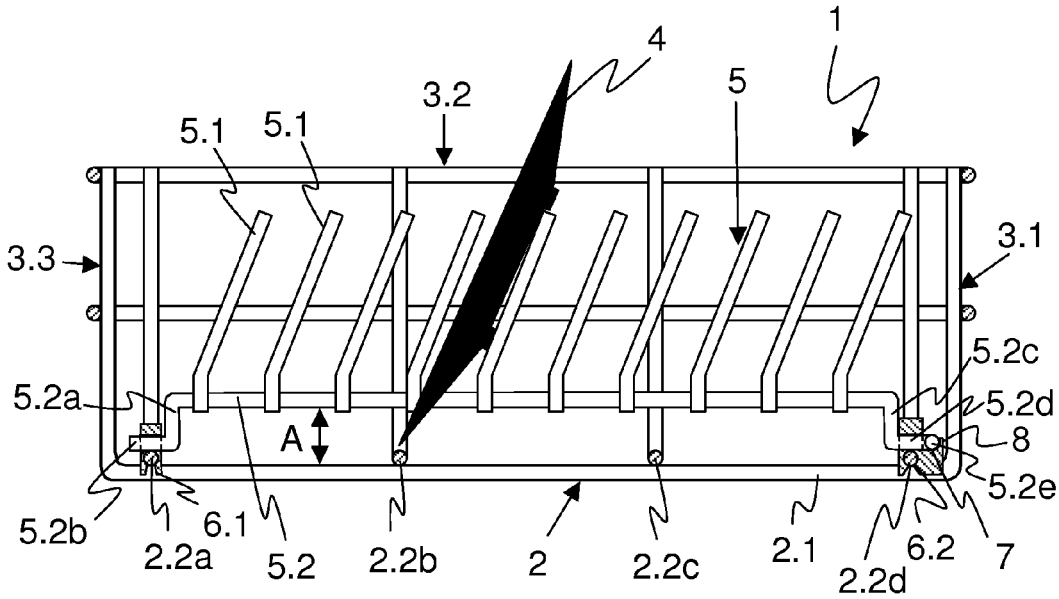
FIG. 1 shows a section through a crockery basket.

FIG. 1 is a schematically shown section through a crockery basket 1 constructed according to the invention. The crockery basket 1 consists of a base mat 2 which forms the bottom of the basket frame 1. The bottom is framed by lateral parts 3.1, 3.2 and 3.3. A fourth side part is not shown. The lateral parts 3.1, 3.2 and 3.3 consist of wires connected together in the manner of a cross, as does the base mat 2 of the bottom. These wires produce slight shielding of the pieces of crockery to be cleaned and, as a result, also very effective drying of the pieces of crockery as no standing water is formed. A piece of crockery 4 is shown schematically in the crockery basket 1.

The base mat 2 consists of longitudinal wires 2.1 and transverse wires 2.2*a* to 2.2*d*. A row 5 of rods is provided for receiving pieces of crockery 4. The row 5 of rods consists of a plurality of rod wires 5.1 which are fastened to a base wire 5.2 for the rods. The rod wire 5.1 is in the present exemplary embodiment fastened at right angles to the base wire 5.2 for the rods, in particular welded thereto and subsequently bent back obliquely thereto. The wire row may also be fastened obliquely to the base wire for the rods. The bending back has the result that the piece of crockery 4 is held obliquely so that no standing water forms on the piece of crockery 4 and thus no drying stains are produced. Preferably, all the main surfaces of the piece of crockery 4 retained are inclined at an angle of approximately 30° relative to the horizontal, so that the water may easily flow off the piece of crockery 4. The piece of crockery 4 is held between two rod wires 5.1 of a row 5 of rods. Thus it is supported further on the base wire 5.2 for the rods.

In particular, the base wire 5.2 for the rods is bent, i.e. offset, at its ends. The angled ends are, in turn, rotatably mounted on the bottom via bearing elements 6.1 and 6.2. The bearing element 6.1 is configured as a loose bearing and the bearing element 6.2 is configured as a fixed bearing.

In the present exemplary embodiment, the base wire 5.2 for the rods has a double bend at its left-hand end. The central piece 5.2*a* produced thereby is angled in the plane of the rod wires 5.1 substantially at right angles to the base wire 5.2 for the rods. The end piece 5.2*b* protruding outwardly after the second bend runs substantially parallel again to the base wire 5.2 for the rods. The end piece 5.2*b* is mounted in the loose bearing 6.1 in a rotatable and longitudinally movable manner. As a result, production tolerances of the individual parts of the crockery basket 1 may be compensated. The bearing element 6.1 is fastened to the transverse wire 2.2*a* of the base mat 2 of the bottom, in particular clipped on.

In the present exemplary embodiment, a triple bend is located at the other end of the base wire 5.2 for the rods. A first central piece 5.2*c* between the first and the second bend is again bent back in the plane of the wire for the rods 5.1, substantially at right angles to the base wire 5.2 for the rods and corresponds to the central piece 5.2*a* of the other end. A second central piece 5.2*d* is aligned with the end piece 5.2*b* and forms therewith a rotational axis for the row 5 of rods. It is rotatably arranged in the fixed bearing 6.2 and positions thereby the row of rods in the longitudinal direction. This bearing element 6.2 is also connected to the bottom, in this case to the transverse wire 2.2*d* of the base mat 2, in particular clipped on. By this construction of a loose bearing 6.1 and a fixed bearing 6.2, tolerances of several millimeters may be compensated, which is not essential for the function of the row 5 of rods, but the production of the crockery basket 1 and the row 5 of rods may be substantially simplified and may be carried out more cost-effectively.

The third bend which, in this exemplary embodiment, is in a plane at right angles to the plane of the rod wires 5.1, results in an end piece 5.2*e* being bent back out of the drawing plane. In the upright position of the row 5 of rods the end piece 5.2*e* bears on a support of the bearing element 6.2 and forms a stop 7. The row 5 of rods may only be pivoted upright to such an extent as permitted by the stop 7 and the end piece 5.2*e*. Folding of the row 5 of rods is only possible in one direction when the end piece 5.2*e* moves away from the stop 7 on the bearing element 6.2. Thus it is ensured that the row 5 of rods is prevented from being folded too far upwards.

The end piece 5.2*e* in the position in which it bears against the stop 7 is secured by means of a catch 8. Only by the deliberate application of force does the end piece 5.2*e* overcome this catch 8 and permit the row 5 of rods to be folded.

The lengths of the central piece 5.2*a* and of the central piece 5.2*c* are tailored to one another so that the base wire 5.2 for the rods is aligned parallel to the bottom and/or to the base mat 2. In particular, by a predetermined length of the central piece 5.2*a* and of the central piece 5.2*c* it is further effected that a spacing A is produced between the base wire 5.2 for the rods and the base mat 2. This spacing A may be selected so that pieces of crockery 4 which are provided for being received in the row 5 of rods do not maintain any contact with the base mat 2 and/or the bottom and also do not protrude through the base mat 2 and/or the bottom. As a result, it is ensured that, for example, spray arms which move underneath the base mat 2, do not come into contact with the piece of crockery 4, and thus could lead to damage of the piece of crockery 4. Moreover, by the use of two rows 5 of rods arranged in parallel, the piece of crockery 4 is received in a stable manner, as is explained in the following figures in more detail.

Figure 2:
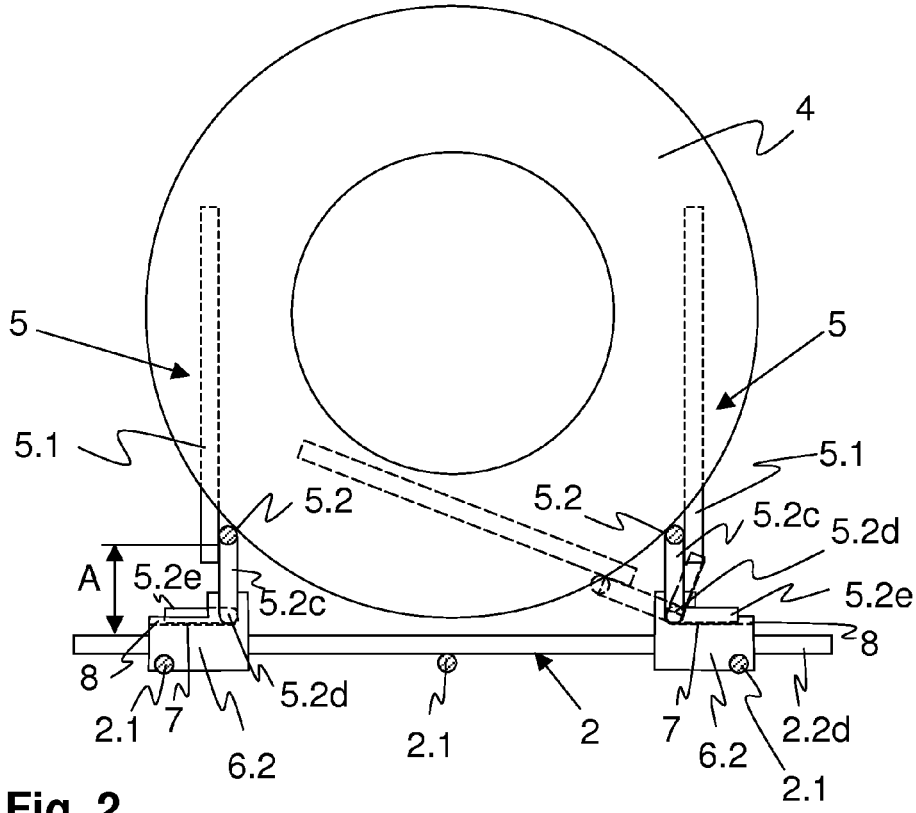
FIG. 2 shows a section through two rows of rods extending parallel.

In FIG. 2 a view transversely to the view of FIG. 1 is accordingly shown in a detail. Thus the piece of crockery 4 is shown, in this case a plate, which is mounted on two base wires 5.2 for the rods extending in parallel. The piece of crockery 4 is further supported on the rod wires 5.1 of the two rows 5 of rods. The base wires 5.2 for the rods are located at a distance A from the transverse wire 2.2*b* in order to prevent the piece of crockery 4 from coming into contact with the transverse wire 2.2*b*. The spacing A may be determined according to the design and arrangement of the row 5 of rods relative to the transverse wires 2.2*a* to 2.2*d* and/or the longitudinal wires 2.1 as a spacing between the base wire 5.2 for the rods and the longitudinal wire 2.1 or as a spacing between the base wire 5.2 for the rods and the transverse wire 2.2*a* to 2.2*d*. In any case it is essential that no contact is made between the piece of crockery 4 provided and one of the longitudinal wires and transverse wires 2.1, 2.2.

The base wire 5.2 for the rods is bent back three times at its end and thus forms the spacing of the base wire 5.2 for the rods from the bottom of the crockery basket 1, a bearing pin for the bearing element 6.2 and an end piece 5.2 for the stop 7. The stop 7 cooperates with the end piece 5.2*e* in the folded-up position of the row 5 of rods. In the view shown in dashed lines, the right-hand row 5 of rods is shown in a position which is not completely folded. The end piece 5.2*e* thus moves from a horizontal position into a vertical position, whilst the rod wires 5.1 come to rest horizontally. A catch 8 may be provided for a fixed end position, both in the folded-up position and also in the folded-down position.

Figure 3:
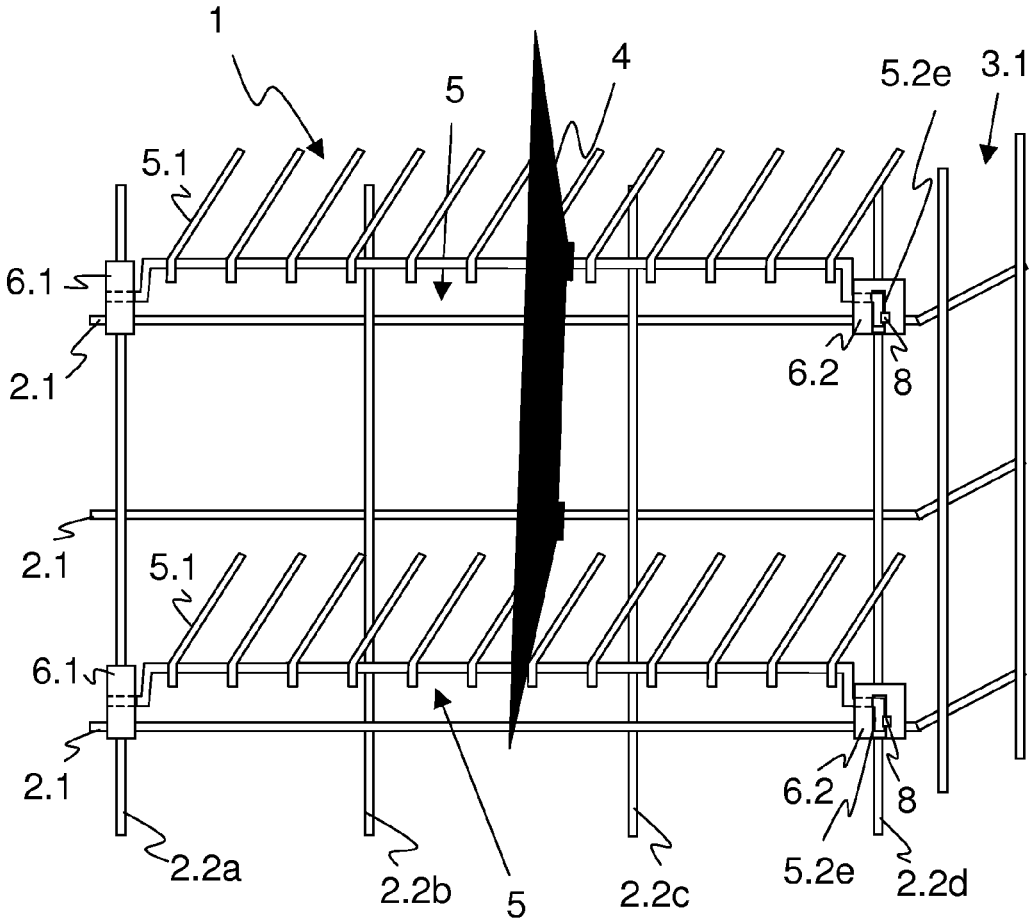
FIG. 3 shows a perspective view of a detail of a crockery basket.

FIG. 3 shows a schematic perspective view of a detail of a crockery basket 1 according to the invention. Again, the two rows 5 of rods extending substantially parallel are shown. Each row 5 of rods has a base wire 5.2 for the rods to which a plurality of rod wires 5.1 are fastened. The ends of the base wire 5.2 for the rods are provided on one side with a triple bend and on the other side with a double bend. As a result, on the side of the triple bend a stop is produced in the horizontal direction by the cooperation with the fixed bearing 6.2 and on the other side, by means of the double bend, a fastening which may be altered in length is produced by the loose bearing 6.1. Production tolerances are compensated by these two different bearing arrangements 6.1 and 6.2. The bearing elements 6.1 and 6.2 are in each case arranged in the point of intersection of the transverse wires 2.2 and the longitudinal wires 2.1. As a result, the bearing arrangements in the crockery basket 1 are fixed in a stable manner. The end pieces 5.2*e* are in this exemplary embodiment guided on both sides by the fixed bearing element 6.2. They are held in position by means of the catch 8.

The row 5 of rods is flexibly arranged on the bottom, in this case on the base mat 2. The piece of crockery 4 is held by the rod wires 5.1 and the base wires 5.2 for the rods between two rows 5 of rods. Contact with the bottom of the crockery basket 1 is avoided by the spacing of the base wires 5.2 for the rods from the bottom of the crockery basket 1 when using the pieces of crockery 4 which have been provided. In the exemplary embodiment of FIG. 3, the two rows 5 of rods are folded in the same direction, i.e. not towards one another. This may be advantageous, in particular, with small spacings of the row 5 of rods relative to one another and long rod wires 5.1.

The present invention is not limited to the exemplary embodiments shown. In particular, similar bends are possible at the ends of the base wires for the rods. It is advantageous, in particular, that no additional bent or angled wire is required, but the spacing of the base wire 5.2 for the rods is solely achieved by its shape. As a result, simple manufacture which is incorporated in the production of the rods is achieved, with only a small amount of time required for angling and/or bending the ends of the wire and thus a clear cost saving is achieved in comparison with known rows of rods. The pieces of crockery are held according to the invention at a distance from the base of the crockery basket, whereby effective cleaning and drying is achieved, combined with stable retention of the pieces of crockery.

List of Reference Numerals

1 Crockery basket
2 Base mat
2.1 Longitudinal wire
2.2*a-d* Transverse wire
3.1-3.3 Lateral parts
4 Piece of crockery
5 Row of rods
5.1 Rod wire
5.2 Base wire for the rods
5.2*a* Central piece
5.2*b* End piece
5.2*c* Central piece
5.2*d* Central piece
5.2*e* End piece
6.1, 6.2 Bearing elements
7 Stop
8 Catch
A Spacing

The invention claimed is:

1. A crockery basket of a dishwasher for receiving pieces of crockery, the crockery basket comprising:

a bottom formed as a wire base mat;

a plurality of lateral parts framing the bottom; and at least one row of rods arranged on the bottom to hold the pieces of crockery, the at least one row of rods having a base wire and a plurality of individual rod wires attached to the base wire, wherein the individual rod wires project outwardly from the base wire in a manner perpendicular with the base wire for a predetermined distance and are then angled laterally from a vertical axis in a direction along a base wire rotational axis and extend from a proximal end generally linearly to a free distal end;

wherein each end of the base wire is bent and pivotally mounted on the bottom for movement of the at least one row of rods between a generally horizontal position and a generally upright position and is arranged on the base mat by a respective rotary bearing element attached to the base wire for base wire rotation therein; and wherein, the at least one row of rods is formed with an offset from the base wire rotational axis resulting in the base wire being raised a distance from the bottom when the row of rods is pivoted upright.

2. The crockery basket of claim 1, wherein one of the rotary bearing elements is a loose bearing and the other rotary bearing element is a fixed bearing for the base wire.

3. The crockery basket of claim 1, wherein the respective rotary bearing element is clipped onto the wire of the base mat.

4. The crockery basket of claim 1, wherein the respective rotary bearing element has a catch for each end of the base wire.

5. The crockery basket of claim 1, wherein at least one end of the base wire has a double bend.

6. The crockery basket of claim 1, wherein at least one end of the base wire has a triple bend.

7. The crockery basket of claim 6, wherein the at least one end of the base wire that has the triple bend forms a stop to limit a tilting motion of the at least one row of rods about the axis of rotation.

8. The crockery basket of claim 1, wherein one end of the base wire has a triple bend and the other end has a double bend.

9. The crockery basket of claim 1, wherein the two ends of the base wire have respective areas extending aligned with one another, and wherein the respective areas form an axis of rotation of the at least one row of rods.

10. The crockery basket of claim 9, wherein at least one of the ends of the base wire is bent back adjacent to the axis of rotation and forms a stop to limit a tilting motion of the at least one row of rods about the axis of rotation.

11. The crockery basket of claim 1, wherein, due to a length of bent ends of the base wire, a spacing of the base wire from the bottom is sufficiently large that the pieces of crockery received between two rows of rods do not come into contact with the bottom.

12. The crockery basket of claim 11, wherein the pieces of crockery are plates.

13. The crockery basket of claim 1, wherein the plurality of individual rod wires are aligned substantially obliquely relative to the base wire.

14. A dishwasher having at least one crockery basket for receiving pieces of crockery, the crockery basket comprising:

a bottom formed as a wire base mat;

a plurality of lateral parts framing the bottom; and at least one row of rods arranged on the bottom to hold the pieces of crockery, the at least one row of rods having a base wire and a plurality of individual rod wires attached to the base wire, wherein the individual rod wires project outwardly from the base wire in a manner perpendicular with the base wire for a predetermined distance and are then angled laterally from a vertical axis in a direction along a base wire rotational axis and extend from a proximal end generally linearly to a free distal end;

wherein each end of the base wire is bent and pivotally mounted on the bottom for movement of the at least one row of rods between a generally horizontal position and a generally upright position and is arranged on the base mat by a respective rotary bearing element attached to the base wire for base wire rotation therein; and wherein, the at least one row of rods is formed with an offset from the base wire rotational axis resulting in the base wire being raised a distance from the bottom when the row of rods is pivoted upright.

* * * * *